United States Patent [19]

Langen et al.

[11] Patent Number: 4,627,880

[45] Date of Patent: Dec. 9, 1986

[54] UNPROCESSED COMPLETE CANE SUGAR AND METHOD OF PRODUCING IT

[75] Inventors: Arnold Langen, Elsdorf; Herta Benecke, Frechen-Grefrath; Udo Breithaupt, Kerpen-Horrem, all of Fed. Rep. of Germany

[73] Assignee: Pfeifer & Langen, Cologne, Fed. Rep. of Germany

[21] Appl. No.: 706,534

[22] Filed: Feb. 27, 1985

[30] Foreign Application Priority Data

Feb. 29, 1984 [DE] Fed. Rep. of Germany ..... 3407364

[51] Int. Cl.[4] ..... F24C 5/00

[52] U.S. Cl. ..... 127/43; 127/55; 127/58

[58] Field of Search ..... 127/30, 43, 42, 55, 127/58

[56] References Cited

FOREIGN PATENT DOCUMENTS 1314630 4/1973 United Kingdom ..... 127/30

OTHER PUBLICATIONS

Honig, "Principles of Sugar Technology" Elsevier Publishing Co. 1953, pp. 494–497.

Derwent Abstract, "Sugarcane Juice Produced in Non-Oxidisable Equipment to Prevent Contamination", 7/17/72.

*Primary Examiner*—R. B. Penland

*Attorney, Agent, or Firm*—Sprung, Horn, Kramer & Woods

[57] ABSTRACT

To produce an unprocessed complete cane sugar with approximately the color and flavor of fresh sugarcane juice and still containing valuable amino acids and vitamins, only up to 50% of the sugarcane juice in terms of the weight of the cane is pressed from ripe, de-leaved, and clean sugarcane with a high sucrose content, the juice is pasteurized at a temperature above the second flocculation point of the waxes, fats, proteins, and pentosans, the flocculate is gently separated out, the purified juice gently thickened below the pasteurization temperature, and the resulting syrup converted into a dry and pourable product by suddenly extracting the residual water.

11 Claims, No Drawings

UNPROCESSED COMPLETE CANE SUGAR AND METHOD OF PRODUCING IT

DESCRIPTION

The invention concerns, first, a method of producing an unprocessed complete cane sugar from sugarcane juice and, second, the resulting new product.

Conventional commercially available white sugar is known to be pure sucrose isolated and freed from associated vegetable materials in the course of a number of purifying operations from the juice of sugar beets or sugarcane. The organic and inorganic associated materials of the plant juices are located in the molasses, which is employed as cattle feed or to produce fermentation products like alcohol and citric acid.

White sugar has for years been attacked as an empty vehicle for calories and energy and because of its alleged unwholesome activity. The view of many nutritionists is tending more and more today toward emphasizing the natural demands of human nutrition and recommending the use of foodstuffs left in their natural state, in which, in addition to nutrients that can be utilized to provide energy, they also contain essential substances in the form of associated materials.

Commercially available raw cane sugar is an intermediate or semifinished product from cane sugar production. The sugar crystals are only partly freed from the adhering syrup, which consists of vegetable associated materials and many technically dictated impurities, and accordingly colored brown. The only stage that raw sugars do not pass through is the last, affination or refining. They are accordingly considered, because of their associated materials, less denatured and hence, erroneously, more "natural" than white sugar, in spite of numerous impurities and of an often poor microbial situation.

There also exist, in regions where sugarcane is cultivated, what are called primitive sugars, obtained from sugarcane juice by hours and often days of boiling down in open pots until the resulting mass hardens upon cooling. Primitive sugars usually contain residues of sand and cellulose and turn out to be very high in bacteria. The long boiling at temperatures as high as 130° C. results in a structure-altering process accompanied by massive destruction of the sucrose and by formation of up to about 17% invert sugar. Primitive sugars produced without bleaches are dark brown and have to some extent a pronounced and astringent caramel flavor that considerably reduces their range of application. Attempts have already been made to separate out some of the proteins by adding flocculation promoters, especially plant juices like coconut milk, and to bleach the syrup by added sulfur-dioxide bleaches in order to produce lighter primitive sugars with a less pronounced inherent flavor.

Fresh sugarcane juice is light in color and very pleasant in flavor, but turns dark in just a few minutes after it has been obtained, and it is assumed that this can be ascribed not to oxidation from air but mainly to contact with ferrous metals. Recommendations have accordingly been made to place the stalks of cane in a container of soap solution, scrub them off, rinse them with cold water, and sterilize them with a high-percentage chlorine solution or boiling water in order to remove the adherent impurities before proceeding to process them into juice. Only tools and machines of rust-free materials should be employed to cut the stalks and obtain the juice (German OS No. 2 215 196). Inhibiting the oxidation of the sugarcane juice, which is usually obtained with iron or steel mills, by adding sufficient quantities of ascorbic acid immediately after the juice has been obtained, has also been recommended. The resulting juice can in either case be crystallized by evaporation or freeze-dried (German OS No. 2 232 949).

Producing conventional cane sugar by centrifuging the sugarcane juice, from which the suspended constituents have been removed, heating it to a boil, and then centrifuging it again to remove nitrogenous non-sugar compounds is also known (Pieter Honig, *Principles of Sugar Technology,* pp. 494 ff.).

It is an object of the invention to develop an actually unprocessed sugar that corresponds to contemporary market demands, meaning that it will be dry, pourable, and hence generally applicable. It was obvious to begin with fresh sugarcane juice, which has been employed in addition to honey from ancient times as a flavorful sweetener. The juice itself is admittedly difficult to offer as an up-to-date sweetener. Shipping costs make it much too expensive, the unavoidable preservation would make it no longer natural, and it would also necessitate much too profound a readjustment of consumption habits. It was accordingly decided that what was necessary was to convert the plant juice as gently as possible while retaining as much of its original composition, the associated materials normally occurring in the plant that is, as possible into a powdered or granulated form.

The method in accordance with the invention of producing an unprocessed complete cane sugar from sugarcane juice consists of pressing only up to 50% of the sugarcane juice in terms of the weight of the cane from ripe, de-leaved, and clean sugarcane with a high sucrose content, pasteurizing the juice at a temperature above the second flocculation point of the waxes, fats, proteins, and pentosans, separating out the flocculation, gently thickening the purified juice below the pasteurization temperature, and converting the resulting syrup into a dry and pourable product by suddenly extracting the residual water.

The cane is preferably pressed only once, being treated so gently that only 40 to 50% juice is obtained in terms of raw weight. The result is that the pressed-out sugarcane juice will contain more than 20 and especially more than 22% by weight of sucrose and that the sucrose content of the juice will be over 90% in terms of the overall solids content.

Sugarcane is conventionally pressed up to 80 to 83%, with the sucrose content frequently amounting to only about 12%. The gentle, meaning partial, pressing of the sugarcane in accordance with the invention makes it recommendable to further process the cane, which will still contain considerable amounts of sugar, as part of conventional sugar production.

The juice obtained by gentle pressing is then preferably pasteurized above the second but below the third flocculation point of the waxes, fats, proteins, and pentosanes it contains. This corresponds to a temperature of 65 to 80° C. and preferably of 75 to 78° C. The sugarcane juice is raised to pasteurization temperature as rapidly as possible and maintained at that temperature 5 to 15 minutes to stabilize the flocculate. The flocculate is subsequently removed along with fibers and other insoluble companions by means of separators. Additional purification of the pasteurized and partly flocculated juice with filter or microorganism-decreasing filter layers can follow.

The differing chemical properties of the natural companions of the sugarcane juice make it possible to define three flocculation points, the first at 48 to 55° C., the second at 58 to 65° C., and the third at 85° C. up to the boiling point of the juice. Inasmuch as pasteurization in accordance with the invention occurs above the second but below the third flocculation point, only the nutritionally insignificant waxes along with some proteins are separated out by the flocculation. Without prior removal of these particularly heat-sensitive waxes and proteins, drying the raw juice would lead only to an unattractive product without a satisfactory flavor.

Since pasteurization in accordance with the invention does not incorporate the third and highest flocculation point, an essential proportion of proteins will remain in the product. It has surprisingly turned out that heating the juice to a temperature between the second and third flocculation point is optimal, not only with respect to the demand that the complete cane sugar being produced be as "unprocessed" as possible and be satisfactory from the microbiological aspect, but also with respect to its having a maximum of flavor at a processability that is technically acceptable for modern plants. The purified juice, which is converted into a dry and pourable product subsequent to gentle thickening, the unprocessed sugarcane juice in accordance with the invention that is, will still contain waxes, proteins, and pentosans that flocculate at higher temperatures, which will be apparent to the consumer when he employs the sugar in clear, hot solutions like tea.

Subsequent to the pasteurization and flocculation separation described herein, the clear and purified sugarcane juice is gently thickened, preferably under vacuum at a maximum temperature of 60° C., usually only 56° C. in practice. This thickens the clear sugarcane juice to a dry-matter (DM) content of 70 to 75%.

To finally convert the resulting syrup into a dry and pourable product, the residual water must be suddenly removed from it. This is preferably done by rapidly heating the thickened syrup to 142 to 155° C. in less than 60 seconds and then expanding it appropriately to allow the residual water to evaporate. The rapid heating in conjunction with letting the vapors escape, in a separation space at atmospheric pressure for example, will reduce the syrup to 92 to 97% dry matter. It is then cooled to at least 10° C. to crystallize it. The syrup that has been reduced to 92 to 97% dry matter can be allowed to flow freely out of the vapor-separation space onto or into appropriate equipment in which exothermic crystallization will occur spontaneously. An appropriate crystallizer of this type would be a steel belt heated in the vicinity of transfer and then cooled, or an open worm conveyor. It is also possible to spray a crystallizable syrup that has been thickened in this way onto the heated steel belt or into an open crystallizer subsequent to appropriate conveyance to distribute it more finely.

Other ways of converting the thickened syrup into a dry and pourable product are vacuum-cylinder drying and vacuum-belt drying.

The dried product can if necessary be subject to still further drying to a moisture content of less than 1%, especially in conjunction with agglomeration in a fluidized bed.

The method in accordance with the invention makes it possible to convert the juice from ripe sugarcane, without structure-altering heating processes and the resulting common discoloring and caramelization reactions and without significant inversion of the sucrose, into a dry form in which the vitamins, especially the B vitamins, and desirable proteins present in the sugarcane juice will remain and be demonstrable. The unprocessed complete cane sugar produced in accordance with the invention has approximately the color and flavor of freshly pressed sugarcane juice, and 100 g of dry matter will contain the following constituents:

| | |
|---|---|
| 89 to 93 g | sucrose |
| 1 to 5 | invert sugar |
| 1 to 4 | minerals and trace elements |
| 1 to 2 | proteins |
| 200 to 800 mg | free amino acids |
| 1 to 5 mg | B vitamins. |

EXAMPLE

40% of the weight of de-leaved and clean sugarcane was pressed out in the form of juice in a mill. The resulting juice, with a sugar content of 20% and a pH of 5.3, was pasteurized by heating with a heat exchanger to 78° C.

After being left to stand for 10 minutes without further heat being supplied and after the formation of a stable flocculate, the juice was conveyed through a clarifying separator and a downstream layer filter and then thickened in the vacuum to 70% dry matter at a maximum product temperature of 56° C.

The thickened syrup was heated to 142° C. within 45 seconds in a spiral-tube evaporator, concentrated to a 95% dry-matter content by vapor precipitation, and then metered out at a pressure of 2 to 3 bar onto a steel belt heated in the vicinity of transfer and cooled over its remaining run.

The dried, foamy and porous, mass was milled, redried to a water content of less than 1% in a fluidized bed, and sifted. The resulting product was a freely flowing powder comparable in color and flavor to that from freshly and fully pressed sugarcane juice.

| Analysis | |
|---|---|
| 91.2% | sucrose |
| 2.5 | invert sugar |
| 2.5 | ash minerals and trace elements) |
| 1.1 | proteins |
| 340 mg | free amino acid |
| 2.6 | B vitamins |
| pH: 5.3. | |

It will be understood that the specification and examples are illustrative but not limitative of the present invention and that other embodiments within the spirit and scope of the invention will suggest themselves to those skilled in the art.

We claim:

1. A method of producing substantially complete cane sugar from sugarcane juice, consisting essentially of pressing sugarcane to squeeze out only up to about 50% of the sugarcane juice contained therein, the juice having a sucrose content of more than 20% by weight and more than 90% sucrose in terms of the total solids content, rapidly heating the juice to a pasteurizing temperature of 65° to 80° C. for 5 to 15 minutes, which temperature is above the second flocculation point and below the third flocculation point of the waxes, fats, proteins, and pentosans, separating the flocculate, thickening the remaining juices at a maximum temperature of 60° C. to form a syrup, and rapidly extracting the residual water from the syrup thereby to form a dry and pourable product.

2. The method according to claim 1, wherein the cane is pressed to squeeze out about 40 to 50% of its juice.

3. The method according to claim 1, wherein the flocculate, fibers, and other insoluble associated materials are removed by means of separators.

4. The method according to claim 1, including the steps of filtering the sugarcane juice subsequent to flocculation to remove microorganisms therefrom.

5. The method according to claim 1, wherein thickening of the clear sugarcane juice is carried to about 70 to 75% dry matter.

6. The method according to claim 1, wherein the thickened syrup is rapidly heated to about 142 to 155° C.

7. The method according to claim 1, wherein the thickened syrup is brought to about 92 to 97% dry matter by the rapid heating followed by subsequently letting the vapors escape.

8. The method according to claim 1, wherein the step of extracting the residual water includes cooling the thickened syrup cooled to at least 10° C. to crystallize the sugar.

9. The method according to claim 7, wherein the the thickened syrup after escape of vapors is transferred into crystallizer which is cooled to at least 10° C.

10. The method according to claim 1, wherein the thickened syrup is put onto a heated steel belt to effect crystallization, and the crystallized product is then cooled.

11. The method according to claim 1, wherein the residual water is extracted from the thickened syrup by spray drying.

* * * * *